US005097748A

United States Patent [19]

Koch et al.

[11] Patent Number: 5,097,748

[45] Date of Patent: Mar. 24, 1992

[54] HYDRAULIC LOCKING CYLINDER WITH THROTTLED SUPPLY OF FLUID DURING UNLOCKING STAGE

[75] Inventors: Georg Koch, Lichtenau; Wolfgang Traupe, Eschwege; Frank van de Poel, Rottenburg; Kurt Schaible, Aidlingen; Holger Seel, Aidlingen, all of Fed. Rep. of Germany

[73] Assignee: Pacoma Hydraulik GmbH, Eschwege, Fed. Rep. of Germany

[21] Appl. No.: 631,353

[22] Filed: Dec. 20, 1990

[30] Foreign Application Priority Data

Dec. 21, 1989 [DE] Fed. Rep. of Germany ..... 3942348

[51] Int. Cl.[5] ..... F15B 15/26

[52] U.S. Cl. ..... 92/16; 92/24; 92/27; 92/28; 91/43; 91/45

[58] Field of Search ..... 92/15, 16, 18, 22, 23, 92/24, 26, 27, 28; 91/41, 43, 44, 45

[56] References Cited

U.S. PATENT DOCUMENTS

| | | | |
|---|---|---|---|
| 3,183,791 | 5/1965 | Cruse | 92/24 |
| 3,314,335 | 4/1967 | Gulick | 92/26 |
| 3,498,182 | 3/1970 | Sheffer et al. | 91/44 |
| 3,584,544 | 6/1971 | Haberman | 92/28 X |
| 4,635,536 | 1/1987 | Liu et al. | 92/24 |
| 4,703,683 | 11/1987 | Sue | 92/24 |
| 4,742,758 | 5/1988 | Rocca | 92/27 X |

FOREIGN PATENT DOCUMENTS

| | | | |
|---|---|---|---|
| 2628872 | 1/1978 | Fed. Rep. of Germany | 92/15 |
| 3041987 | 6/1982 | Fed. Rep. of Germany | 92/15 |
| 0562618 | 5/1957 | Italy | 91/44 |
| 0234801 | 1/1969 | U.S.S.R. | 92/15 |

*Primary Examiner*—Edward K. Look
*Assistant Examiner*—John Ryznic
*Attorney, Agent, or Firm*—Max Fogiel

[57] ABSTRACT

A hydraulic cylinder that locks into position has a housing (1) with at least one pressure connection (7) and a piston (3) and rod (6) that travel tight in an out of the housing. The locking mechanism comprises a piston (11) that rests against a spring (35) and a barrier mechanism (23) with a cage of balls (25) that roll radially into a locking position in a locking groove (26) and back into an unlocking position in an unlocking groove (22). The primary piston communicates with a hollow space (18) and acts on a primary participating surface (19) and the locking piston communicates with an unlocking space (13) and acts on an unlocking surface (14) by way of the pressure connection. There is a variable choke (17), which disengages after a while, beween the pressure connection and the primary space (18) in the primary piston (3). The unlocking space in the locking piston (11) can be supplied with fluid without being choked by way of the pressure connection, so that, once fluid has been supplied from the pressure connection, no pressure can build up in the primary space until the locking piston has left its locking position.

11 Claims, 2 Drawing Sheets

HYDRAULIC LOCKING CYLINDER WITH THROTTLED SUPPLY OF FLUID DURING UNLOCKING STAGE

BACKGROUND OF THE INVENTION

The invention concerns a hydraulic cylinder that locks into position, with a housing with at least one pressure connection and a piston and rod that travel tight in an out of the housing, whereby the locking mechanism comprises a piston that rests against a spring and a barrier mechanism with a cage of balls that roll radially into a locking position in a locking groove and back into an unlocking position in a locking groove, and whereby the primary piston communicates with a hollow space and acts on a primary participating surface and the locking piston communicates with an unlocking space and acts on an unlocking surface by way of the pressure connection. Hydraulic lock-into-position cylinders are employed to activate structures—a lid, a lever, or a similar component for example—that are articulated to the rod of the primary piston and can be activated by applying force to the piston. The piston can be forced in one or both directions and can even be operated differentially. The present invention, however, is unaffected by which of these modes are employed. It is necessary to be able to mechanically lock the primary piston into a ready position when it is not being subjected to pressure through the pressure connection. It must also be possible to reliably attain the locking potion once the primary piston has traveled back into its ready position due to pressure against the rod end if the cylinder is double-action or to the weight of the output component on the rod if the cylinder is single-action.

Hydraulic lock-into-position cylinders of the aforesaid type are known from German Patent 2 911 071 and German OS 3 732 561. The cylinder disclosed in the patent has a primary piston that travels in and out of the housing and has a locking surface that communicates with a hollow space and can be directly subjected to pressure at the housing by way of the pressure connection. The primary piston extends into a cage for the balls in a barrier mechanism that is surrounded by a sleeve-like locking piston. The return-space end of the piston rests against a locking spring. Since the locking piston has an unlocking surface that can also be subjected in communication with an unlocking space by way of a line that branches off the pressure connection, pressure can build up in the primary space and in the unlocking space simultaneously. The primary piston, however, cannot as yet leave its ready position because the barrier mechanism is still in the locking position. Not until the locking piston has traveled out of the locking position and into the unlocking position against the force of the locking spring can the balls in the barrier mechanism move radially out of the locking groove and into the unlocking groove, and only then can the primary piston travel. The direct subjection of the locking surface of the primary piston to pressure from the pressure connection, however, subjects the balls in the barrier mechanism to force in the locking position and squeezes them to a certain extent because the primary piston transmits tension through the balls even though it cannot leave its ready position. The sudden subjection of the overall unlocking surface of the locking piston to pressure accelerates the locking piston into the unlocking position, and the balls in the barrier mechanism leap out radially just as suddenly, with the result that the primary piston begins to move suddenly. This is in many cases undesirable and even a drawback to the output component. Another drawback is that air cannot leave the reversing space in the locking piston, which accommodates the locking spring, and the barrier mechanism may become hydraulically blocked if the seal on the locking piston is loose and allows fluid to enter and occupy the reversing space. In this case as well the reversing space in the locking piston, which accommodates the locking spring, constitutes a closed volume. If the balls are distributed inside the barrier mechanism such that they can be accommodated as in a cage in a sleeve that projects out of the primary piston, there is another drawback in that they can rub against the cylindrical wall of the housing while the primary piston is traveling, and the resulting damage will lead to leakage on the part of the seal on the primary cylinder. If, on the other hand, the balls in the barrier mechanism are mounted stationary on an extension and do not participate in the axial motion of the primary piston, this drawback will be absent, although the primary space and the unlocking space will still be simultaneously subjected to hydraulic pressure, and the primary piston will again begin to move suddenly once it has been subjected to pressure and the barrier mechanism has disengaged.

SUMMARY OF THE INVENTION

The object of the instant invention is to eliminate the suddenness that the primary piston begins to move with when subjected to pressure and to ensure that the piston will leave its ready position gently.

This object is attained in accordance with the present invention by a variable choke, which disengages after a while, between the pressure connection and the primary space in the primarily piston, whereas the unlocking space in the locking piston can be supplied with fluid without being choked by way of the pressure connection, so that, once fluid has been supplied from the pressure connection, no pressure can build up in the primary space until the locking piston has left its locking piston. Therefore, when fluid is supplied through the pressure connection, the pressure can initially build up unchoked in the unlocking space and only by way of the choke, and hence later, in the primary space in the primary piston. Accordingly, there will still be no tension on the balls in the barrier mechanism when the locking piston leaves its locking position, and the balls will not be squeezed, but can move freely to the extent that the locking piston has left its locking position, and they can travel from the locking groove into the unlocking groove. The choke will simultaneously ensure only a constricted pressure build-up in the primary space, and the primary piston will be forced out of its ready position by this constricted or decreased pressure and will leave that position gently. The choke is simultaneously disengaged and the constriction eliminated, allowing all the pressure deriving from the pressure connection to build up in the primary space and take effect as necessary to activate the output component. The axial length of the choke can be varied to render the time at which the choke disengages depend on the distance traveled by the locking piston. This approach will in any event ensure that the constrictive action will not be terminated until the locking piston has actually left its locking position. The choking action terminates before the locking piston can completely attain its unlocking position. The synchronization also includes the geometry and speed of the motion of the components of the barrier mechanism. This approach allows the balls in the barrier mechanism to leave their barrier position subject to no significant tension from the primary piston and the pressure to build up initially unconstricted and then constricted in the primary space, so that the primary piston can begin moving gently and then continue its motion with enough force to activate the output component.

The locking piston can be a graduated piston with, in addition to the unlocking surface, another participating surface at one end to accommodate pressure from the primary space. The unlocking surface must in any event be extensive enough to overcome the force of the locking spring during unconstricted fluid supply from the pressure connection, so that the locking piston will be reliably transferred from the locking position to the unlocking position due to that supply along. The locking piston can have another participating surface that is subjected to fluid from the primary space to secure the locking piston in the unlocking position while the primary piston is traveling forward. The graduation on the graduated piston can simultaneously be exploited to generate the functional components of the barrier mechanism.

A one-way valve can be positioned between the primary space and the pressure connection, opening toward the connection and in a line that detours around the choke. This line connects the pressure connection or the unlocking space with the primary space and detours around the choke. The one-way valve opens toward the pressure connection and is intended to allow the hydraulic fluid in the primary space to flow back into the pressure connection while the primary space is returning to its ready position. The primary piston simultaneously travels into its locked ready position, and the previously disengaged constrictive action of the choke will become re-engaged, allowing the hydraulic fluid to be accelerated out of the primary space and into the pressure connection and the control line that it communicates with through the opening one-way valve. A one-way valve is necessary only when this procedure is desired. It will not be needed when the primary piston in the hydraulic cylinder is moving slowly enough for enough fluid to flow back through the choke. The one-way valve and its associated detour line will also be unnecessary when constricted displacement of the hydraulic fluid out of the primary space is desirable to allow the primary piston to attain the ready position that it is locked into. The choke's resetting capability can be exploited in a practical way for this second procedure in special cases. The one-way valve can be positioned in the locking piston. There is generally enough space there, especially when the piston has a circular cross-section in contrast with one that has an annular cross-section. It is of course also possible to piston the detour line that connects the pressure connection to the primary space, detours around the choke, and accommodates the one-way valve at the housing end.

The choke that disengages after a while can be a constriction between one cylindrical section of the locking piston and a bore in the housing or a component positioned stationary in the housing. Thus, no separate component will be needed to make a choke that disengages after a while. All that is necessary is to adjust the length of the overlap between the cylindrical section and the bore to attain the desired length of time, the time, that is, during which the locking piston will travel the desired distance, forcing the cylindrical section completely out of the bore and disengaging the choke to allow hydraulic fluid to be supplied to the primary space unconstricted. The constriction itself can be dimensioned to affect the constricted pressure build-up in the primary space.

The locking spring in the locking piston can be accommodated in a space that communicates with the atmosphere. This setup will allow air to escape, an leaks in the seal on the locking piston will no longer lead to hydraulic obstruction of the barrier mechanism. Operating reliability will be increased. The same approach will ensure that the barrier mechanism can also leave its barrier position and accordingly that the primary piston can execute is regular stroke.

The end of the locking piston that faces away from the primary piston can have a projection that the locking piston travels along from the locking piston into the unlocking position subject to the engagement of mechanical force. In many applications it is unnecessary or desirable when the hydraulic pressure fails to be able to manually disengage the locking position to make it possible to manually activate the output component as desired in the absence of pressure. For this purpose the barrier mechanism must first be disengaged. The projection on the locking piston allows mechanical intervention to shift the locking piston out of its locking position and into the unlocking position, releasing the barrier and allowing the primary piston to move.

The locking piston can be positioned to move in opposition to the primary piston with its second participating surface next to the primary space, and the locking spring can be positioned along with the ventilated space at the other end of the locking piston. The space that accommodates the locking spring in this preferred embodiment communicates with the atmosphere in a very simple way. The projection is completely unsealed. In other embodiments, with the locking piston moving in the same direction as the primary piston out of the locking position and into the unlocking position, the ventilation is usually somewhat more difficult. The air in this case, however, can also be channeled out through the primary piston. The reversing space can also communicate with the reversing space in the primary piston, in which case it must be ensured that the hydraulic cylinder is not operated in a differential system, which would make it impossible to release the barrier mechanism. If on the other hand the hydraulic cylinder is also operated differentially, the locking-piston reversing space must be ventilated in a different way, through a longitudinal bore in the piston rod for example.

The projection on the locking piston can have a groove that is accessible to mechanical intervention from outside. This will allow the locking piston to be shifted out of the locking position and into the unlocking position.

The primary piston can have a projecting sleeve to accommodate the balls in the barrier mechanism, and the locking groove can be rigidly mounted on a locking bushing in the housing. The radius of the locking bushing can be adjusted to ensure that the ball in the barrier mechanism will not rub against the cylindrical bore in the housing while the primary piston is executing its stroke.

BRIEF DESCRIPTION OF THE DRAWINGS

Two preferred embodiments of the invention will now be specified with reference to the drawing, wherein.

DESCRIPTION OF THE PREFERRED EMBODIMENTS

Figure 1:
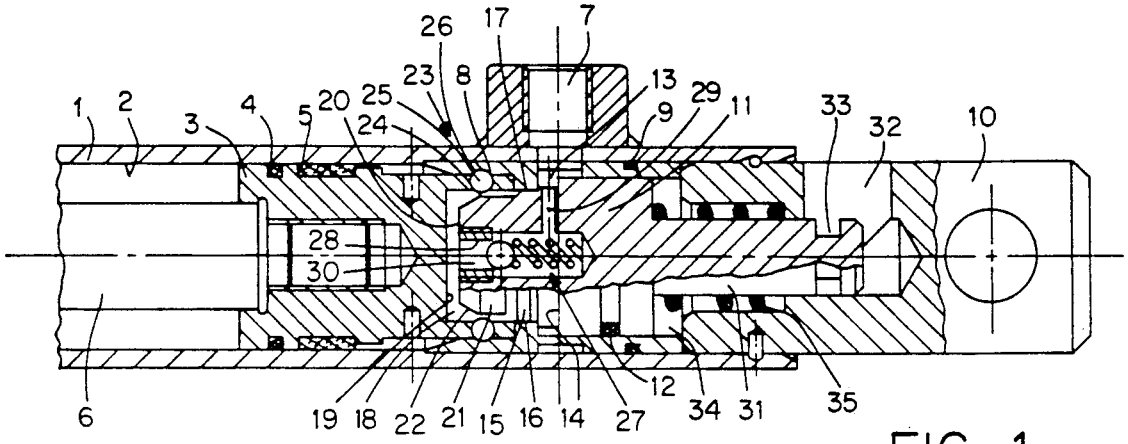
FIG. 1 is a section through one embodiment of a hydraulic cylinder in the locking position.
Figure 2:
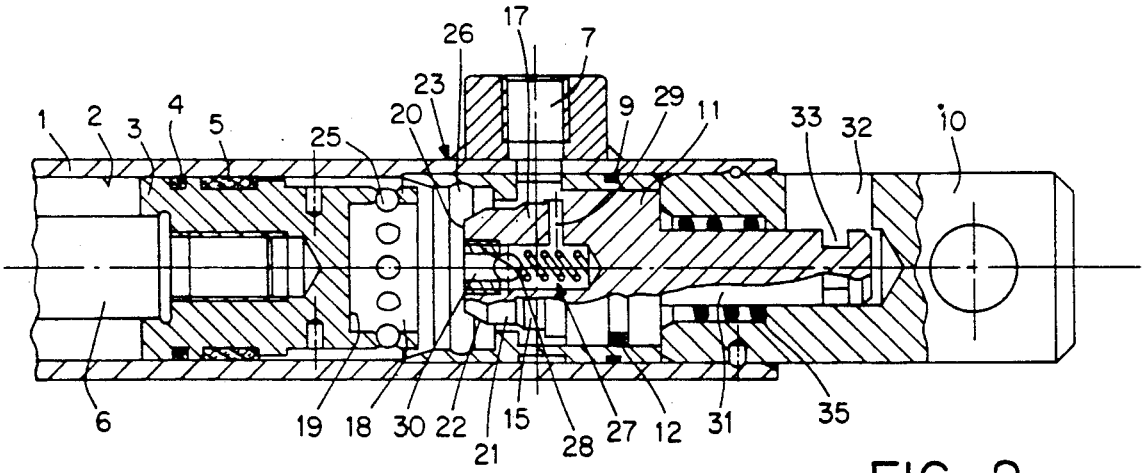
FIG. 2 is a section through the hydraulic cylinder illustrated in FIG. 1 while the primary cylinder is executing a stroke.

The hydraulic cylinder in FIGS. 1 and 2 has a housing 1 with a bore 2. A primary piston 3 travels back and forth in the bore, sealed by a seal 4 and positioned by a ring 5. Secured to, screwed into for example, primary piston 3 is a piston rod 6. The other, unillustrated, end of the rod extends out of housing 1 and is attached to an output component, which it accordingly activates.

Mounted on the housing is pressure connection 7. A line that supplies hydraulic fluid can be aligned with connection 7 to activate primary piston 3 etc. For simplicity's sake only one pressure connection 7 is illustrated and only a single-action primary piston 3 will be specified herein. Using a double-action piston and several pressure connections is in no way detrimental to the invention, however. Secured stationary in a setback in the bore 2 in housing 1 is a locking bushing 8. The bushing is sealed off from the outside atmosphere by a seal 9. Locking bushing 8 is secured in position by a lid 10 inserted into housing 1. The lid can be of a different shape or can be welded or otherwise fastened to housing 1. A locking piston 11 travels back and forth to a limited extent in locking bushing 8. Piston 11 is sealed in with a seal 12. The stroke of locking piston 11 is limited by stops. Between locking piston 11 and locking bushing 8 is an unlocking space 13 that constantly communicates with pressure connection 7. Adjacent to unlocking space 13, the locking piston has an unlocking surface 14 in the form, as will be evident, of a ring. Locking piston 11 also has a cylindrical section 15 associated with a bore 16 in locking bushing 8. Cylindrical section 15 constitutes in conjunction with bore 16 a choke 17 in the form of an appropriate constriction. The cross-section and length of this constriction determine its function. Choke 17 represents the connection between unlocking space 13 and a primary space 18 that exists in any event between locking piston 11 and primary piston 3. Hydraulic fluid from unlocking space 13 and hence from pressure connection 7 can only reach primary space 18 through choke 17. Primary piston 3 has, adjacent to primary space 18, a primary participating surface 19 that must be subjected to hydraulic fluid to initiated a stroke on the part of primary piston 3.

Locking piston 11, however, features not only unlocking surface 14 but at the same end, adjacent to primary space 18 and on the other side of choke 17, another participating surface 20 in the form of a circle that extends radially more or less as far as choke 17. In this vicinity the locking piston has an obstructing cylinder 21 and an unlocking groove 22, both of which function in conjunction with a barrier mechanism 23 that can mechanically lock primary piston 3 into the ready position (with not pressure deriving from pressure connection 7) illustrated in FIG. 1. Associated with barrier mechanism 23 is a cage-like projecting sleeve 24 that accommodates and positions balls 25, which are positioned in individual radial conical depressions distributed along the circumference of projecting sleeve 24. The balls can move radially only to a limited extent in relation to projecting sleeve 24. Locking bushing 8 features a locking groove 26 that accommodates balls 25 in a locking position. In this locking position, which is illustrated in FIG. 1, balls 25 have entered locking groove 26 and are prevented from escaping radially inward by the position of locking piston 11 in relation to obstructing cylinder 21.

Accommodated in locking piston 11 is a one-way valve 27 that, as will be evident from the figure, includes a ball that rests against a spring that forces it against a seat 28 screwed into locking piston 11 in the locked piston. A radial bore 29 constitutes in conjunction with an axial channel 30 a line 29 and 30 that accommodates one-way valve 27. Line 29 and 30 connects primary space 18 to unlocking space 13, detouring around the other route by way of choke 17. The directionality of one-way valve 27 ensures that hydraulic fluid can travel back out of primary space 18 and into unlocking space 13 and hence pressure connection 7 by way of line 29 and 30 but never in the other direction.

Locking piston 11 has a projection 31 on the other side of seal 12 that extends with no additional sealing through lid 10 to a recess 32 that provides access from outside to a groove 33 in projection 31. Mechanical intervention can accordingly be initiated from outside on the projection 31 of locking piston 11, which can therefore be displaced axially even when no hydraulic fluid is present or available through pressure connection 7. In the rear of locking piston 11 and at the housing end is a space 34 that constantly communicates with the atmosphere through sealed projection 31 and is accordingly ventilated. Supported at the housing end in space 34 or in lid 10 is a locking spring 35 that engages locking piston 11, forcing barrier mechanism 23 into the locking position, whereby obstructing cylinder 21 prevents balls 25 from escaping radially inward out of locking groove 26.

The regular starting position or ready position of primary piston 3 with barrier mechanism 23 locked is illustrated in FIG. 1. If compressed hydraulic fluid is supplied through an unillustrated control line and pressure connection 7, the pressure will build up in unlocking space 13, although it will be impossible to supply primary space 18 through choke 17. The force acting on the unlocking surface 14 of locking piston 11 will overcome the force of locking spring 35 and displace the piston out of the locking position and into the unlocking position (FIG. 2), in which it rests against lid 10, which acts as a stop. Since the pressure of the hydraulic fluid can build up only to a comparatively limited extent by way of choke 17, no significant force is being applied at this time to primary piston 3 or its primary participating surface 19. The balls 25 in barrier mechanism 23 can accordingly easily emerge from locking groove 26 as soon as the movement of locking piston 11 pistons unlocking groove 22 opposite them, releasing barrier mechanism 23 and hence disengaging the mechanically locked position of primary piston 3 and escaping unlocking groove 22 radially inward. Immediately thereafter or even to some extent simultaneously with this procedure, the cylindrical section 15 of locking piston 11 travels out of the bore 16 in locking bushing 8, disengaging choke 17. The narrow cross-section is out of the way and the full control pressure of the hydraulic fluid can not build up and act in primary space 18. In the sequence just described, barrier mechanism 23 is released before the control pressure builds up completely against the primary participating surface 19 of primary piston 3, and the piston will begin moving gently once barrier mechanism 23 has been released. As soon as choke 17 is disengaged, however, the total pressure will be able to act on primary piston 3, which will accordingly be able to activate the output component as intended. FIG. 2 illustrates this position, with primary piston 3 having completed part of its travel. Locking spring 35 is compressed while primary piston 3 is stroking forward, securing locking piston 11 in its unlocking position (FIG. 2). Balls 25 will not, due to the particular cage-like design, fall inward into primary space 18. Other measures may also be taken as described in relation to the second embodiment to counteract the tendency of balls 25 to fall inward or outward.

Once the output component has been activated—a lever displaced or pivoted for example—in accordance with the prescribed primary-piston stroke, if that component is now to be disengaged again, the pressure in the control line and hence in pressure connection 7 is lowered again, so that either a tension or the weight of the output component will be sufficient to return primary piston 3 to its ready position. It is of course also possible to us a double-action hydraulic cylinder and subject primary piston 3 to pressure from the piston-rod end. Primary piston 3 will return in either case, and, once the pressure in pressure connection 7 has been reduced, locking spring 35 will restore locking piston 11 to the ready position illustrated in FIG. 1 before balls 25 enter their locking position. The balls, rather, are entrained by the return motion of primary piston 3 subject to projecting sleeve 24. They will come to rest during the last component of the primary piston's return stroke in unloading groove 22 and will displace locking piston 11 against the force of locking spring 35 backward in the same direction until they arrive adjacent to locking groove 26 in stationary locking bushing 8. Once this position has been attained, balls 25 will be able to escape radially outward, and locking spring 35 will force locking piston 11 into the locking position illustrated in FIG. 1. The ready position of primary piston 3 is now mechanically secured again. During this backward stroke, choke 17 will engage again when cylindrical section 15 enters bore 16, and the two parts will overlap, creating the constriction. From this time on, primary space 18 can be evacuated through choke 17 only subject to certain conditions. One-way valve 27 will accordingly now open, allowing the pressure to decrease and the hydraulic fluid to overflow out of primary space 18 and into unlocking space 13 and hence into line 29 and 30 and the open one-way valve 27. If it is desirable for the return stroke of primary piston 3 to be very gentle and gradual too, it is of course possible to eliminate one-way valve 27 and line 29 and 30.

In the event of a malfunction, when for example it is impossible for pressure to build up by way of pressure connection 7, barrier mechanism 23 can be released by mechanical intervention in the grooves 33 in projection 31. Locking piston 11 is simultaneously retracted against the force of locking spring 35 into the unlocking position, unblocking primary piston 3 and allowing an emergency stroke on the part of the piston to be executed by the application of additional force to the output component or to piston rod 6. Upon completion of the stroke, primary piston 3 can also be restored again to tis ready position and locked into position again mechanically by barrier mechanism 23.

Figure 3:
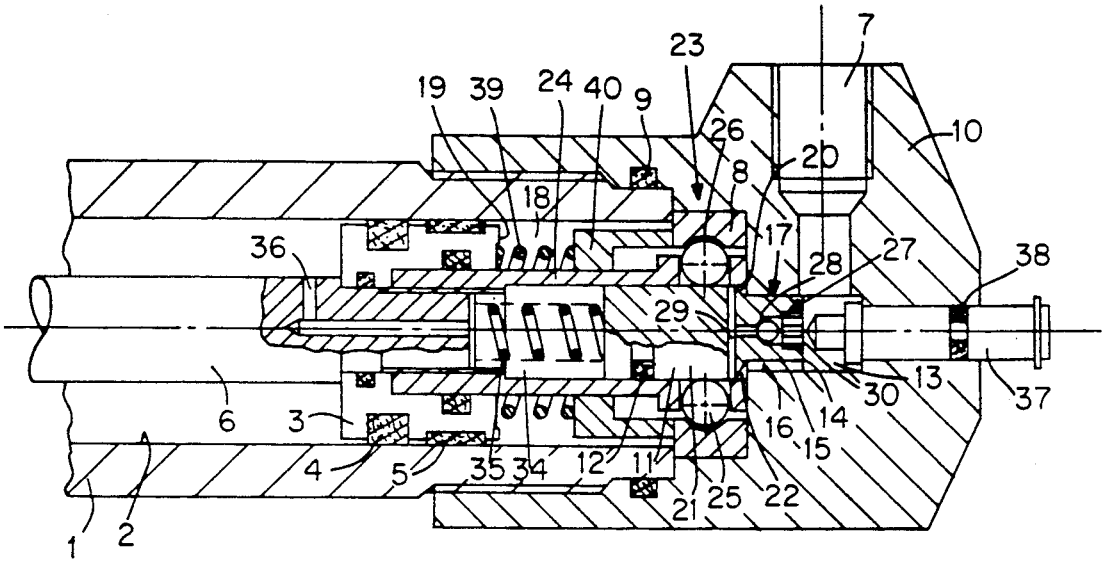
FIG. 3 is a section through another embodiment of the hydraulic cylinder in the locking position.
Figure 4:
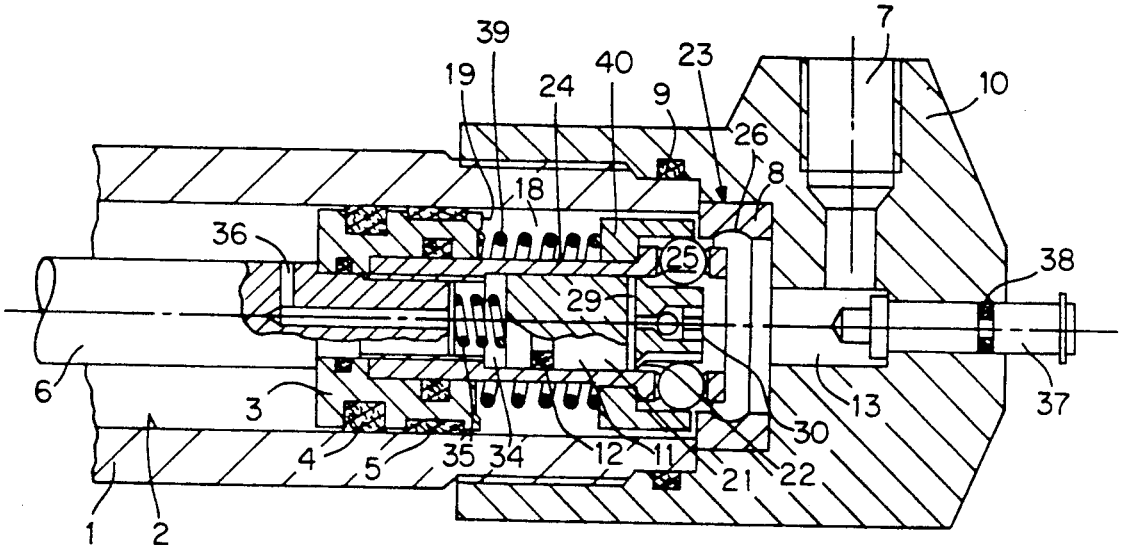
FIG. 4 is a section through the hydraulic cylinder illustrated in FIG. 3 while the primary cylinder is executing a stroke.

The operation of the hydraulic cylinder illustrated in FIG. 3 and 4 is similar. Once the pressure has been introduced at the housing end by way of pressure connection and once equivalent pressure has built up in unlocking space 13, locking piston 11 will be shifted out of the locking position and into the unlocking position, releasing barrier mechanism 23. Only a decelerated and constricted pressure can build up in primary space 18 at this time. Only once the cylindrical section 15 of locking piston 11 has left bore 16, which consists in the present case of lid 10, will choke 17 disengage, allowing the pressure to continue building up in primary space 18 unconstricted. Primary piston 3 can accordingly travel gently out of its locking position and begin its stroke. Mechanical release is also possible in this case, and mechanical locking will occur as soon as the ready position is attained again.

I claim:

1. A hydraulic cylinder that locks into position comprising: a housing with at least one pressure connection; a primary piston and rod traveling in and out of said housing; locking means having a locking piston resting against a spring; barrier means in said locking means and having a cage of balls rolling radially into a locking position in a locking groove, said cage of balls rolling back into an unlocking position in an unlocking groove; said locking piston communicating with a hollow primary space in said primary piston; said primary piston communicating with an unlocking space in said locking piston and acting on an unlocking surface through said pressure connection; a variable throttle between said pressure connection and said primary space in said primary piston; said unlocking space being supplied with fluid without choking through said pressure connection; pressure in said primary space being inhibited from rising until said locking piston has left a locking position after fluid has been supplied to said unlocking space through said pressure connection; said variable throttle being disengageable with time delay when said primary piston is stationary; said variable throttle being located through a throttle gap between a cylinder section on said locking piston and a bore in said housing so that throttling is controlled by displacement of said locking piston; total pressure in said pressure connection being transmitted to said primary space after unlocking said primary piston, pressure medium in said primary space being fed back through the throttle when disengaged in said pressure connection until said primary piston reaches an end position.

2. A hydraulic cylinder as defined in claim 1, wherein said locking piston is a graduated piston, said unlocking surface and an auxiliary surface at one end of said locking piston holding pressure from said primary space.

3. A hydraulic cylinder as defined in claim 1, including a one-way valve between said primary space and said pressure connection and opening toward said pressure connection in a line passing around said throttle.

4. A hydraulic cylinder as defined in claim 1, wherein said spring in said locking piston is located in a space communicating with atmospheric pressure.

5. A hydraulic cylinder as defined in claim 1, wherein said locking piston has an end facing away from said primary piston, said end of said locking piston having a projection, said locking piston traveling along said projection from said locking position into an unlocking position.

6. A hydraulic cylinder as defined in claim 1, wherein said locking piston is positionable to move in an opposite direction to said primary piston, said locking spring being located in a space communicating with atmospheric pressure at an end of said locking piston.

7. A hydraulic cylinder as defined in claim 5, wherein said projection on said end of said locking piston has a groove accessible from outside.

8. A hydraulic cylinder as defined in claim 1, including a projecting sleeve on said primary piston for receiving said balls in said barrier means; and a locking bushing in said housing and mounting rigidly said locking groove.

9. A hydraulic cylinder that locks into position comprising: a housing with at least one pressure connection; a primary piston and rod traveling in and out of said housing; locking means having a locking piston resting against a spring; barrier means in said locking means and having a cage of balls rolling radially into a locking position in a locking groove, said cage of balls rolling back into an unlocking position in an unlocking groove; said locking piston communicating with a hollow primary space in said primary piston; said primary piston communicating with an unlocking space in said locking piston and acting on an unlocking surface through said pressure connection; a variable throttle between said pressure connection and said primary space in said primary piston; said unlocking space being supplied with fluid without choking through said pressure connection; pressure in said primary space being inhibited from rising until said locking piston has left a locking position after fluid has been supplied to said unlocking space through said pressure connection; said variable throttle being disengageable with time delay when said primary piston is stationary; said variable throttle being located through a throttle gap between a cylinder section on said locking piston and a bore in said housing so that throttling is controlled by displacement of said locking piston; total pressure in said pressure connection being transmitted to said primary space after unlocking said primary piston, pressure medium in said primary space being fed back through the throttle when disengaged in said pressure connection until said primary piston reaches an end position; a one-way valve between said primary space and said pressure connection and opening toward said pressure connection in a line passing around said throttle; said one-way valve being positioned in said locking piston.

10. A hydraulic cylinder that locks into position comprising: a housing with at least one pressure connection; a primary piston and rod traveling in and out of said housing; locking means having a locking piston resting against a spring; barrier means in said locking means and having a cage of balls rolling radially into a locking position in a locking groove, said cage of balls rolling back into an unlocking position in an unlocking groove; said locking piston communicating with a hollow primary space in said primary piston; said primary piston communicating with an unlocking space in said locking piston and acting on an unlocking surface through said pressure connection; a variable throttle between said pressure connection and said primary space in said primary piston; said unlocking space being supplied with fluid without choking through said pressure connection; pressure in said primary space being inhibited from rising until said locking piston has left a locking position after fluid has been supplied to said unlocking space through said pressure connection; said variable throttle being disengageable with time delay when said primary piston is stationary; said variable throttle being located through a throttle gap between a cylinder section on said locking piston and a bore in said housing so that throttling is controlled by displacement of said locking piston; total pressure in said pressure connection being transmitted to said primary space after unlocking said primary piston, pressure medium in said primary space being fed back through the throttle when disengaged in said pressure connection until said primary piston reaches an end position; said throttle being a constriction between a cylindrical section of said locking piston and a bore in said housing.

11. A hydraulic cylinder as defined in claim 1, wherein said choke is a constriction between a cylindrical section of said locking piston and a stationary component positioned in said housing.

* * * * *